US006161778A

United States Patent [19]

Haruch

[11] Patent Number: 6,161,778

[45] Date of Patent: Dec. 19, 2000

[54] AIR ATOMIZING NOZZLE ASSEMBLY WITH IMPROVED AIR CAP

[75] Inventor: James Haruch, Naperville, Ill.

[73] Assignee: Spraying Systems Co., Wheaton, Ill.

[21] Appl. No.: 09/330,746

[22] Filed: Jun. 11, 1999

[51] Int. Cl.[7] ..... B05B 1/28

[52] U.S. Cl. ..... 239/290; 239/419; 239/427.3; 239/396

[58] Field of Search ..... 239/290, 296, 239/299, 419, 427, 424, 433, 545, 427.3, 431, 396, 432

[56] References Cited

U.S. PATENT DOCUMENTS

| | | | |
|---|---|---|---|
| 4,537,357 | 8/1985 | Culbertson et al. | 239/290 |
| 4,592,506 | 6/1986 | Capes et al. | 239/424 |
| 4,961,536 | 10/1990 | Correard | 239/296 |
| 5,344,078 | 9/1994 | Fritz et al. | 239/296 |
| 5,435,491 | 7/1995 | Sakuma | 239/296 |
| 5,549,246 | 8/1996 | Kukesh | 239/296 |

*Primary Examiner*—James Hook
*Assistant Examiner*—Dinh Q. Nguyen
*Attorney, Agent, or Firm*—Leydig, Voit & Mayer, Ltd.

[57] ABSTRACT

An air assisted spray nozzle assembly is provided. The spray nozzle including a nozzle body having a liquid inlet passage and a gas inlet passage. The air cap is disposed at a downstream end of the nozzle body and includes an outer body member having an inner bore extending from an open upstream end thereof. A fluid directing insert is inserted in the inner bore of the outer body member. The fluid directing insert has a fluid directing passage extending therethrough which communicates with the liquid inlet passage in the nozzle body. An impingement element is also inserted into the inner bore of the outer body member downstream from the fluid directing insert. The impingement element defines an impingement surface spaced from and opposing the fluid directing passage for deflecting a stream of liquid impinging thereon in a radially outward direction. The outer body of the air cap also includes a plurality of longitudinally extending discharge passages arranged in surrounding relation to and extending downstream from the impingement surface. Each discharge passage has a discharge orifice therein for directing fluid in an inward flow path such that the flow paths produced by the respective discharge orifices impinge on one another and atomize the liquid.

24 Claims, 5 Drawing Sheets

AIR ATOMIZING NOZZLE ASSEMBLY WITH IMPROVED AIR CAP

FIELD OF THE INVENTION

The present invention relates generally to air assisted spray nozzles, and more particularly to an improved more versatile air cap that can be used with air assisted nozzle assemblies for enhanced liquid particle breakdown and distribution.

BACKGROUND OF THE INVENTION

In many spray applications, such as humidification or evaporative cooling, it is desirable to generate relatively fine spray particles so as to maximize surface area for distribution in the atmosphere. For this purpose, it is known to use air assisted spray nozzle assemblies in which a pressurized gas such as air is used to break down or atomize a liquid flow stream into very fine liquid particles. For example, in some air assisted nozzle assemblies the liquid is mechanically broken down primarily in an atomizing chamber located in the nozzle assembly upstream from a spray tip or air cap which serves to form the discharging spray pattern. Alternatively, the liquid particle break down can occur in the air cap itself.

From an efficiency and economic operating standpoint it is also desirable that such particle breakdown be effected using relatively low air flow rate and pressure. Heretofore this has created problems. In particular, spray tips or air caps which provide efficient and economic operation are generally relatively complex in design, and hence relatively expensive to produce.

Additionally, these air caps are also very limited in terms of flexibility of use. For example, such air caps are typically designed so that they can only be used with a specific air assisted nozzle body configuration. Accordingly, differently configured air caps must be provided for each type of nozzle. Moreover, such air caps cannot be easily customized to discharge the liquid in different spray patterns.

Another problem with existing air atomized spray nozzles, and in particular nozzles used for spraying a coating or paint onto a surface, is that the high air pressure necessary to breakdown the fluid particles results in a high nozzle discharge pressure. This high discharge pressure often causes the particles to bounce back from the surfaces upon which they are applied. This not only can adversely affect the applied coating and create waste in material, but also can create an environmental hazard by virtue of the spray particles which are discharged into the surrounding ambient air.

OBJECTS AND SUMMARY OF THE INVENTION

It is an object of the present invention to provide an air assisted spray nozzle assembly having an improved air cap which is effective for enhanced liquid particle breakdown and distribution.

Another object is to provide an improved and more versatile air cap which can be used in air assisted nozzle bodies of various designs.

A related object is to provide such an air cap which can be used in air assisted nozzles in which the liquid flow stream is pre-atomized prior to direction into the air cap, as well as air assisted nozzles in which the separate liquid and air streams are directed into the air cap.

Yet another object is to provide an air cap of the foregoing type which can be easily customized for the desired discharging spray pattern.

A further object is to provide an air cap of the foregoing type which provides enhanced atomization of the fluid at a relatively low nozzle discharge pressure.

Yet another object is to provide an air cap of the above kind which is relatively simple in design and which lends itself to economical manufacture.

These and other features and advantages of the invention will be more readily apparent upon reading the following description of a preferred exemplary embodiment of the invention and upon reference to the accompanying drawings wherein:

While the invention will be described and disclosed in connection with certain preferred embodiments and procedures, it is not intended to limit the invention to those specific embodiments. Rather it is intended to cover all such alternative embodiments and modifications as fall within the spirit and scope of the invention.

DETAILED DESCRIPTION OF THE PREFERRED EMBODIMENT

Figure 1:
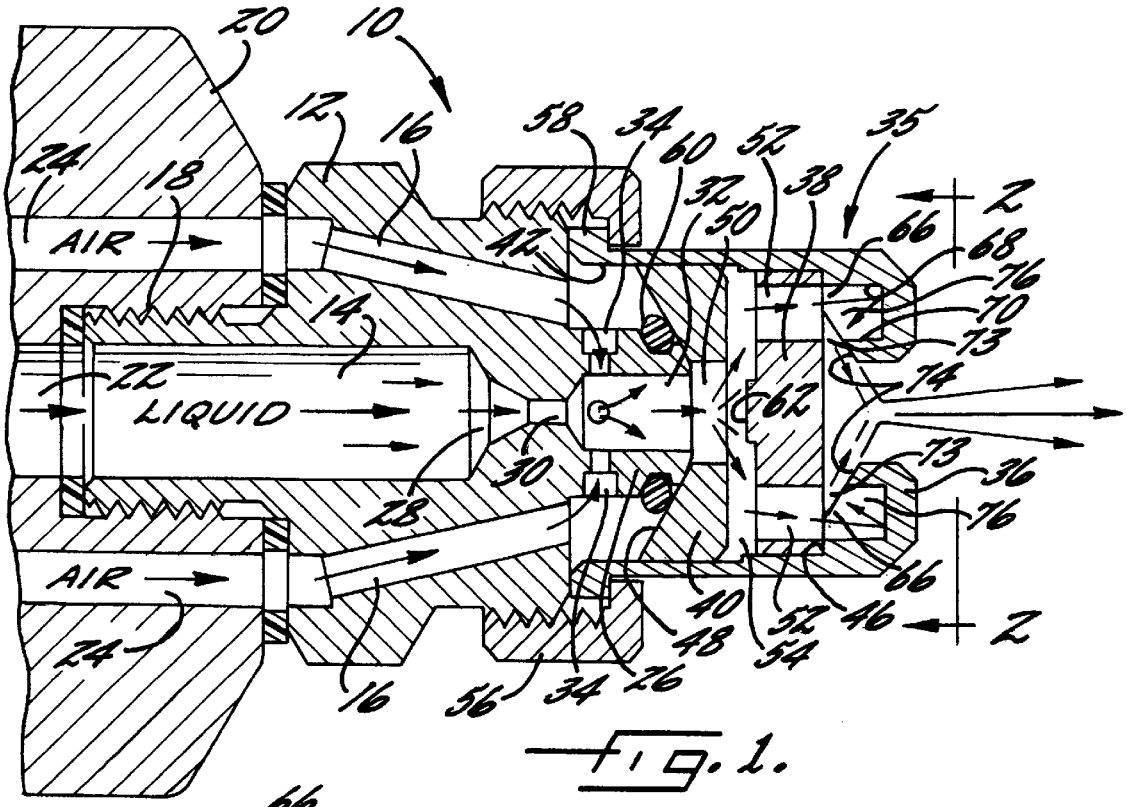
FIG. 1 is a section view taken axially through an illustrative air assisted spray nozzle assembly which incorporates the features of the present invention.

Referring now more particularly to FIG. 1, there is shown an illustrative air assisted nozzle assembly 10 embodying the present invention. The nozzle assembly 10 uses a pressurized gas such as air to atomize a liquid flow stream into very fine particles so as to maximize surface area. While the present invention is described in connection with particular illustrated spray nozzle assemblies, it will be readily appreciated that the present invention is equally applicable to spray nozzles having different configurations.

The illustrated spray nozzle assembly 10 includes a main body 12 formed with a central liquid inlet passage 14 and an annular surrounding gas inlet passage 16. The main body 14, in this case, is connected to a base portion 20 of the nozzle assembly 10 via a generally cylindrical rearwardly extending extension 18 on the main nozzle body 12. The rearward extension 18 of the main nozzle body is received in an internally threaded cavity in the base portion 20 such that the liquid and gas inlet passages 14, 16 in the main body are aligned with corresponding liquid and gas inlet passages 22, 24 in the base portion. Liquid and gas inlet ports (not shown) which communicate respectively with the liquid and gas inlet passages 22, 24 are provided on the base portion 20. In a known manner, suitable supply lines can be attached to the liquid and gas inlet ports to supply the nozzle assembly 10 with pressurized streams of liquid and gas.

In the embodiment of the invention illustrated in FIG. 1, the nozzle assembly 10 includes a pre-atomizing section 26. The pre-atomizing section 26, in this case, is formed with a central inlet passage 28 which communicates with a flow restricting orifice 30 that, in turn, communicates with cylindrical expansion chamber 32. Pressurized gas in the annular gas inlet passage 16 is directed into the expansion chamber 32 through a plurality of radial air passages 34. Thus, as will be understood by one skilled in the art, the pressurized liquid introduced through the liquid inlet passage 14 is accelerated through the restricting orifice 30 into the expansion chamber 32 where it is broken up and pre-atomized by a plurality of pressurized air streams directed through the radial passages 34. Further details regarding the configuration of the pre-atomizing section are provided in co-pending U.S. patent application Ser. No. 08/934,348, the disclosure of which is incorporated by reference. Of course, those skilled in the art will appreciate that other configurations and methods may be employed for atomizing the liquid.

Figure 3:
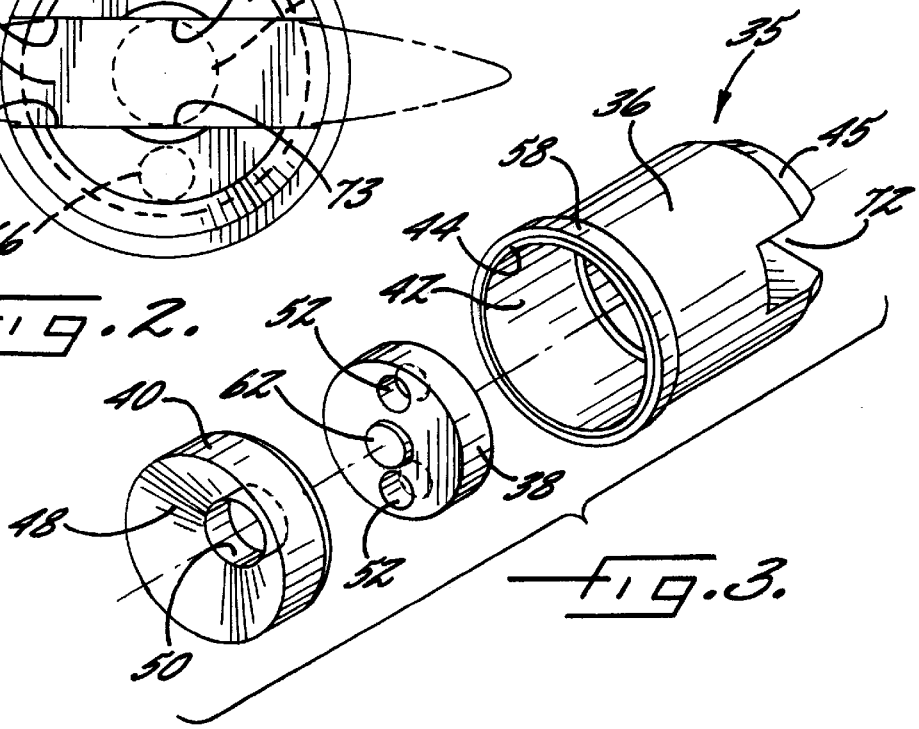
FIG. 3 is an exploded perspective view of the air cap of the spray nozzle assembly shown in FIG. 1.

In accordance with an important aspect of the present invention, for enhancing atomization and for directing the liquid particles into a well defined spray pattern, the nozzle body 12 is provided with an air cap 35 which comprises a plurality of easy to manufacture and assemble components that can be readily customized for particular spray applications. In particular, to this end, the illustrated air cap 35 comprises an outer shell or body 36, an impingement element 38 and a fluid directing insert 40. As shown in FIGS. 1 and 3, the outer body 36 of the air cap 35 has a generally cylindrical bore 42 extending longitudinally therethrough from an open inlet end 44 towards a discharge end 45. The impingement element 38 and fluid directing insert 40 are generally disc-shaped and are inserted and press fit into the cylindrical bore 42 of the outer body 36 through the open inlet end 44 thereof with the fluid directing insert 40 being arranged upstream relative to the impingement element 38. When the impingement element 38 is inserted, it is arranged against an annular shoulder 46 provided on the interior surface of the outer wall 68 of the air cap body 36 near the discharge end 45 as shown in FIG. 1. This annular shoulder 46 ensures that the impingement element 38 is arranged in the proper location and orientation relative to the air cap outer body 36.

Figure 2:
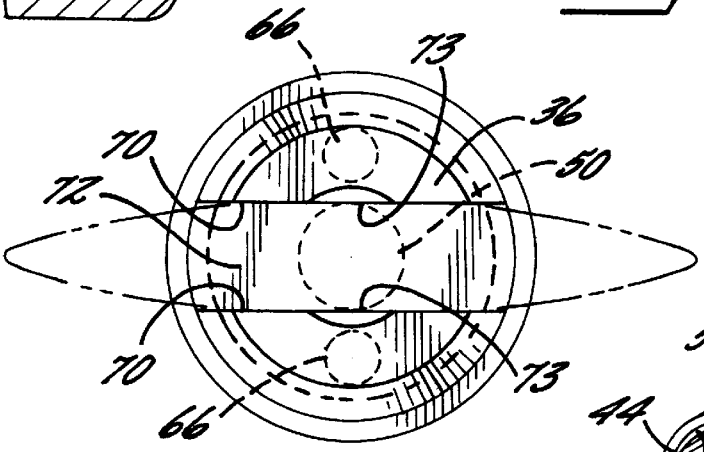
FIG. 2 is an enlarged end view taken through the plane of line 2—2 of FIG. 1.

For directing fluid and air through the air cap 35, the fluid directing insert 40 has a conical entry surface 48 which tapers inwardly towards a central orifice 50 which extends through the fluid directing insert 40. Additionally, the impingement element 38 has a plurality of fluid directing orifices 52 extending therethrough. The plurality of fluid directing orifices 52 in the impingement element 38, two orifices in the embodiment shown in FIGS. 1–3, are disposed at circumferentially spaced locations adjacent the perimeter of the impingement element 38. As shown in FIG. 1, when the impingement element 38 and the fluid directing insert 40 are arranged in the air cap body 36, the fluid directing insert is longitudinally spaced a short distance from the impingement element so as to define a fluid passageway 54 between the air directing and impingement elements. This fluid passageway 54 communicates with both the central orifice 50 in the fluid directing insert 40 and the pair of fluid directing orifices 52 in the impingement element 38.

For connecting the air cap 35 to the nozzle body 12, threads are provided on an external surface of the nozzle body adjacent the forward end thereof. As shown in FIG. 1, an internally threaded retainer ring 56, which is configured to engage the threads on the nozzle body 12 and an annular collar 58 provided on the outer surface of the air cap body 36, secures the air cap 35 to the nozzle body. When the air cap 35 is mounted on the nozzle body 12, at least a portion of the pre-atomizing section 26 extends into the inlet end 44 of the air cap body 36 so that the atomized fluid from the pre-atomizing section 26 is directed into the air cap 35. More specifically, as shown in FIG. 1, the open discharge end of the expansion chamber 32 engages the fluid directing insert 40 such that the atomized liquid exiting the expansion chamber is directed through the central orifice 50 in the fluid directing insert 40. An o-ring seal 60 is arranged about the perimeter of the expansion chamber 32 adjacent the downstream or discharge end thereof. When the air cap 32 is mounted on the nozzle body 12, the o-ring seal 60 engages the tapered entry surface 48 of the fluid directing insert 40 to prevent air in the gas inlet passage 16 from bypassing the pre-atomizing section 26.

To provide further atomization of the liquid downstream from pre-atomization section 26, the central portion of the impingement element 38 defines an impingement surface 62 opposite the central orifice 50 in the fluid directing insert 40. In the illustrated embodiment, the impingement surface 62 includes a raised disc portion which, when assembled in the outer body, is concentric with the central orifice 50 of the fluid directing insert 40. Thus, the atomized liquid which exits the pre-atomizing section 26 is directed via the central orifice 50 against the impingement surface 62 which deflects the liquid radially outward through the fluid passageway 54 towards the fluid-directing orifices 52 in the impingement element 38.

For discharging the atomized fluid, the fluid directing orifices 52 in the impingement element 38 communicate with discharge passages 66 formed in the outer air cap body 36. In particular, as shown in FIG. 1, the discharge passages 66 have an open upstream end for receiving atomized fluid exiting the fluid directing orifices 52 and are defined by the outer wall 68 of the air cap body and an opposing inner side wall 70. Discharge orifices 73 are provided in the respective inner side wall 70 of each of the discharge passages 66. As shown in FIGS. 2 and 3, the two discharge passages 66 define a laterally extending central channel 72 in the discharge end of the air cap body 36. In the illustrated embodiment, the discharge orifices 73 comprise notches formed in the inner side wall 70 of each of the discharge passages 66 which extend into the respective discharge passages. The notches, in this instance, are angled radially inward toward each other so as to provide opposed slotted discharge orifices 73 on either side of the central channel 72. Each of the notched discharge orifices are further defined by respective deflector surfaces 74 which, in this case, are curved to form a crescent shape in at least a portion thereof. Additional details regarding the discharge orifices are provided in co-pending U.S. patent application Ser. No. 08/934,348.

For providing enhanced fluid particle breakdown and increased stability of the resulting atomized fluid discharge, each of the discharge passages 66 has a recess or cavity 76 arranged downstream from the respective discharge orifice 73. These downstream recesses 76 deflect fluid rearwardly or in the upstream direction to provide further atomization of the liquid particles as they exit the discharge orifice. As shown in FIGS. 1 and 2, the finely atomized flat spray streams which are discharged through the discharge orifices 73 are deflected by the deflector surfaces 74 radially inwardly where the sprays impinge on one another to produce the final discharge pattern. This construction produces more efficient atomization in that a given volume of liquid may be broken into particles with relatively high surface area even though the air stream is supplied to the nozzle assembly at a comparatively low volumetric rate.

Figure 8:
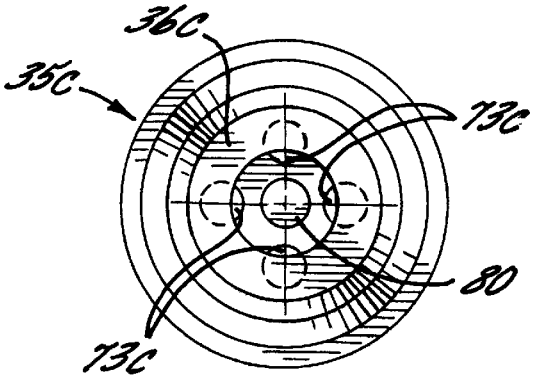
FIG. 8 is an enlarged end view taken through the plane of line 8—8 of FIG. 7.

In further keeping with the invention, the individual components of the air cap 35 can be made with customized designs to enhance more particular spray applications. For example, the impingement element 38 can be made with different numbers of fluid directing orifices 52. As shown in FIG. 2, providing the impingement element 38 with two fluid directing orifices 52 will create an elliptical spray pattern. Use of an impingement element 38 with four fluid directing orifices 52, as depicted in FIG. 8, will create a round spray pattern. It will be understood that the impingement element 38 alternatively could be manufactured with other numbers and configurations of fluid directing orifices 52 for customized spraying.

In addition, the discharge orifices 73 formed in the outer body 36 can be formed with discharge orifices 73 at larger and/or deeper angles for customized spraying. For example, making the angle of the discharge opening 73 larger will widen the discharging spray pattern, with all other factors being constant. As will be appreciated by one skilled in the art, each of the individual components used in the air cap 35 has a relatively simple construction which allows it to be easily manufactured utilizing standard machining techniques. Moreover, by manufacturing the outer body 36 with different discharge orifices 73 and the impingement element 38 with different fluid flow passage arrangements, it will be understood that assembly of particular combinations of those elements will enable easy manufacture of air caps having a wide variety of discharging spray patterns. Therefore, since each of the elements can be manufactured on a standard basis, assembly of a wide variety of customized air caps can be easily and economically produced.

Figure 4:
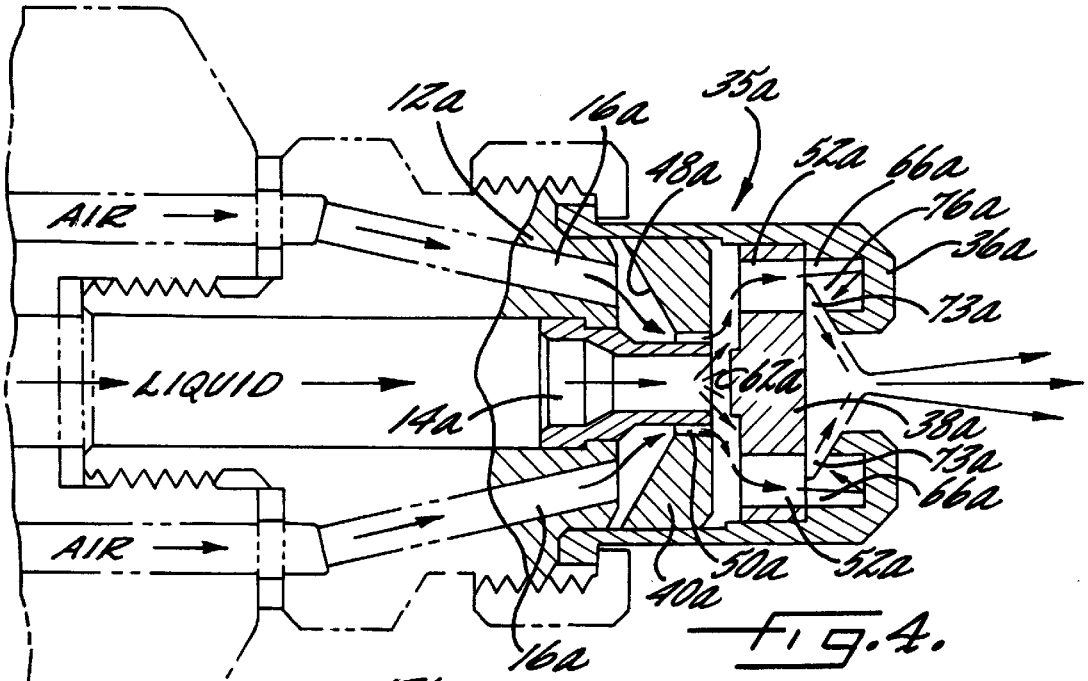
FIG. 4 is a section view taken axially through an alternative embodiment of a spray nozzle assembly according to the present invention.

In accordance with a further aspect of the present invention, the air cap 35 is also readily useable with air-assisted nozzle bodies having different designs. In particular, an alternative embodiment of the present invention is shown in FIG. 4 in which an air cap 35*a* substantially the same as that described above is used in combination with a nozzle body that is configured to direct separate liquid and air streams into the air cap. For ease of reference, in the embodiment shown in FIG. 4, items similar to those described above have been given similar reference numerals with the suffix "a" added. As shown in FIG. 4, in this particular embodiment, the nozzle body 12*a* does not include a pre-atomizing section. Instead, both a liquid stream and an annular surrounding air stream, which are carried in respective inlet passages 14*a*, 16*a* in the nozzle body, are directed against the impingement surface 62*a* defined by the impingement element 38*a* of the air cap.

To this end, when the air cap 35*a* is mounted on the nozzle body 12*a*, the end portion of the liquid inlet passage 14*a* of the nozzle body extends at least partially through the central orifice 50*a* of the fluid directing insert 40*a*. Since the liquid inlet passage 14*a* has a smaller diameter than the central orifice 50*a* in the fluid directing insert 40*a*, an annular space or passage 78 is defined which extends between the side of the liquid inlet passage 14*a* and the edge of the central orifice 50*a*. The air which exits the gas inlet passage 16*a* in the nozzle body 12*a* is directed inwardly by the tapered entry surface 48*a* of the fluid directing insert 40*a* and through this annular space 78. As depicted in FIG. 4, when the liquid stream from the liquid inlet 14*a* strikes the impingement surface 62*a*, it is forced in a radially outward direction, and is then sheared by the annular air stream which passes through the central orifice 50*a* in the fluid directing insert 40*a* to provide atomization of the liquid. Thereafter, in a similar fashion to the embodiment shown in FIGS. 1–3, the atomized fluid is forcefully directed through the plurality of fluid directing orifices 52*a* in the impingement element 38*a* into the discharge passages 66*a* formed in the air cap outer body 36*a* and ultimately outwardly through the discharge orifices 73*a* formed therein. Thus, the air cap configuration of the present invention can be easily adapted for use with air assisted nozzles in which separate liquid and gas streams are directed into the air cap.

Figure 5:
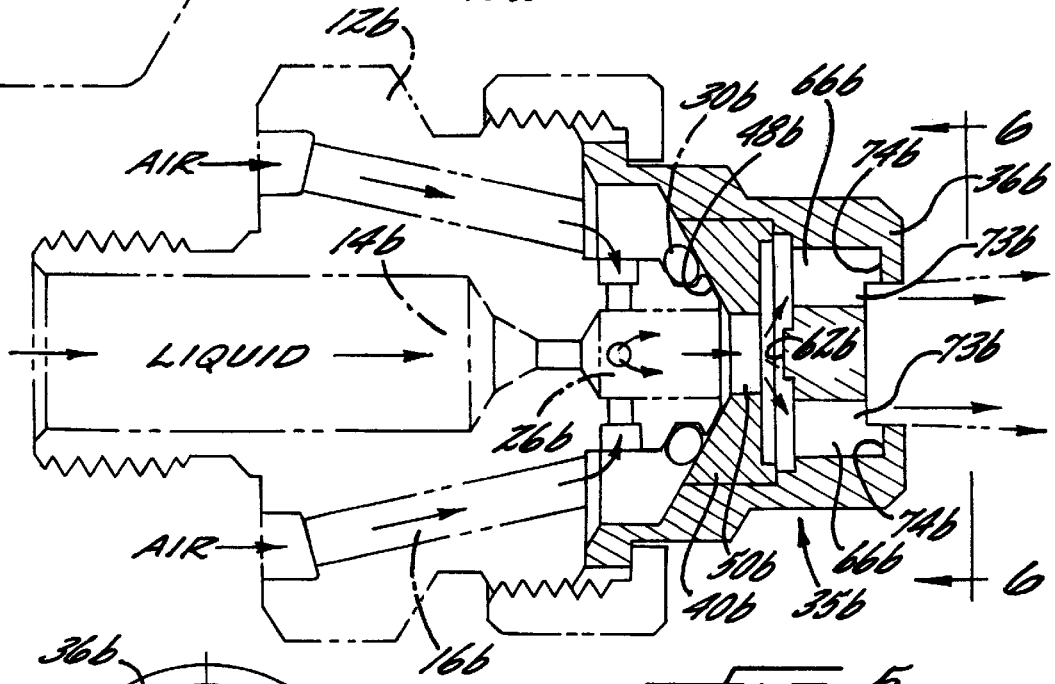
FIG. 5 is a section view taken axially through another alternative embodiment of a spray nozzle assembly according to the present invention.
Figure 6:
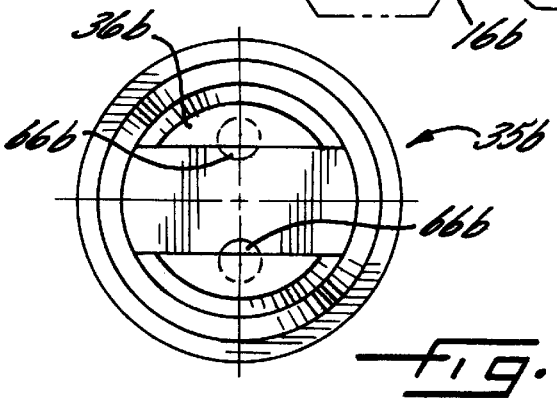
FIG. 6 is an enlarged end view taken through the plane of line 6—6 of FIG. 5.

A further alternative embodiment of the present invention is shown in FIGS. 5 and 6 wherein the distinguishing suffix "b" is used to designate items similar to those already described. As shown in FIG. 5, the air cap 35*b* is again designed to be used with a nozzle body 12*b* having a pre-atomizing section 26*b*. Thus, the air cap 35*b* includes a fluid directing insert 40*b* which engages the open discharge end of the pre-atomizing section 26*b* and directs the pre-atomized liquid exiting the expansion chamber 32*b* through the central orifice 50*b* and against an impingement surface 62*b*. However, instead of being defined by a separate insertable impingement element, the impingement surface 62*b* is formed as an integral part of the air cap body 36*b*. The impingement surface 62*b* deflects the atomized fluid radially outward and into the plurality of discharge passages 66*b*, in this case two, formed in the air cap outer body 36*b*. Discharge orifices 73*b* are provided in the discharge passages 66*b* which have deflector surfaces arranged at approximately 90° relative to the fluid path for producing a relatively narrow discharge spray pattern. Unlike the embodiments of the invention shown in FIGS. 1–4, the embodiment shown in FIGS. 5 and 6 does not include pockets or recesses arranged downstream from the discharge openings.

Figure 7:
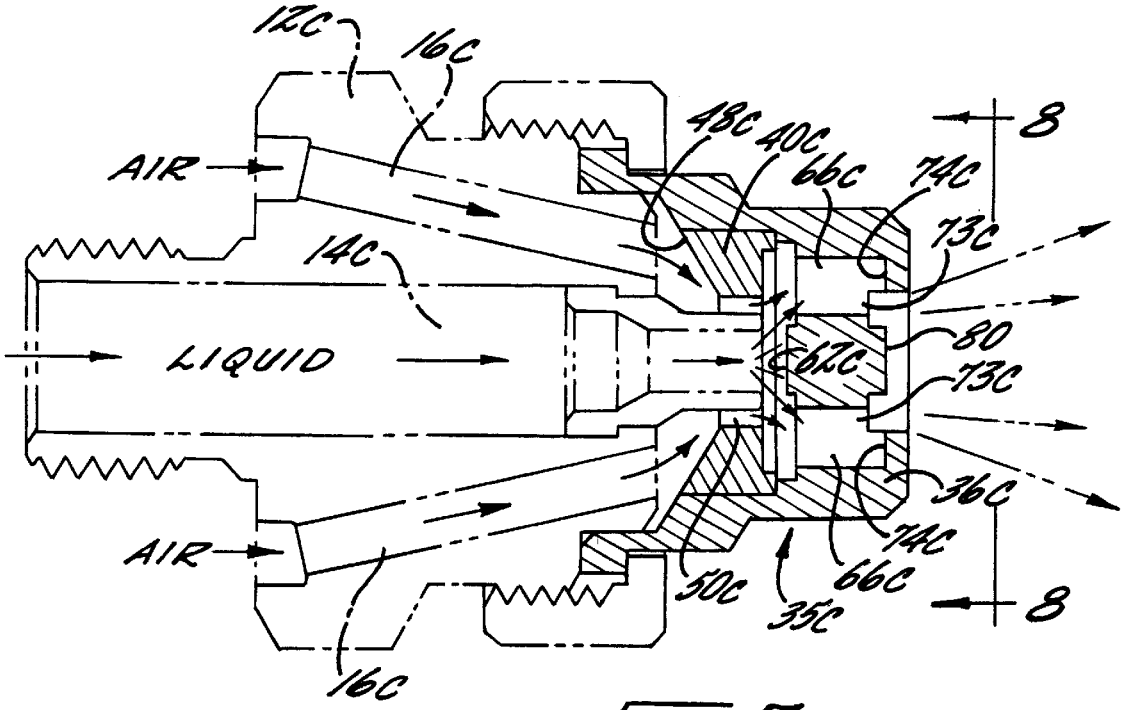
FIG. 7 is a section view taken axially through yet another alternative embodiment of a spray nozzle assembly according to the present invention.

As shown in FIGS. 7 and 8 (similar items having the suffix "c"), the air cap configuration of FIGS. 5 and 6 can also be readily adapted for use on an air assisted nozzle body which does not utilize a pre-atomizing section. More particularly, in a similar fashion to the FIG. 4 embodiment, when the air cap 35*c* is mounted on the nozzle body 12*c*, the end portion of the liquid inlet passage 14*c* extends through the central orifice 50*c* in the fluid directing insert 40*c*. Likewise, the air from the gas inlet passage 16*c* is again forced via the tapered entry surface 48*c* through the annular space 78*c* defined by the outer wall of the liquid inlet 14*c* and the edge of the central orifice 50*c*. The annular air stream which is produced by the fluid directing insert 40*c* then shears the liquid which is deflected radially outwardly by the impingement surface 62*c*. The now atomized liquid is forced into, in this case, four discharge passages 66*c* in the air cap body 36*c*. Discharge orifices 73*c* having 90° deflector surfaces 74*c* are once again provided. An additional deflector surface 80 is provided on the exterior of the air cap body 36*c* between the individual discharge openings. The discharging streams impinge on the external deflector 80 in order to further break-up the streams and produce the final discharge pattern.

Figure 9:
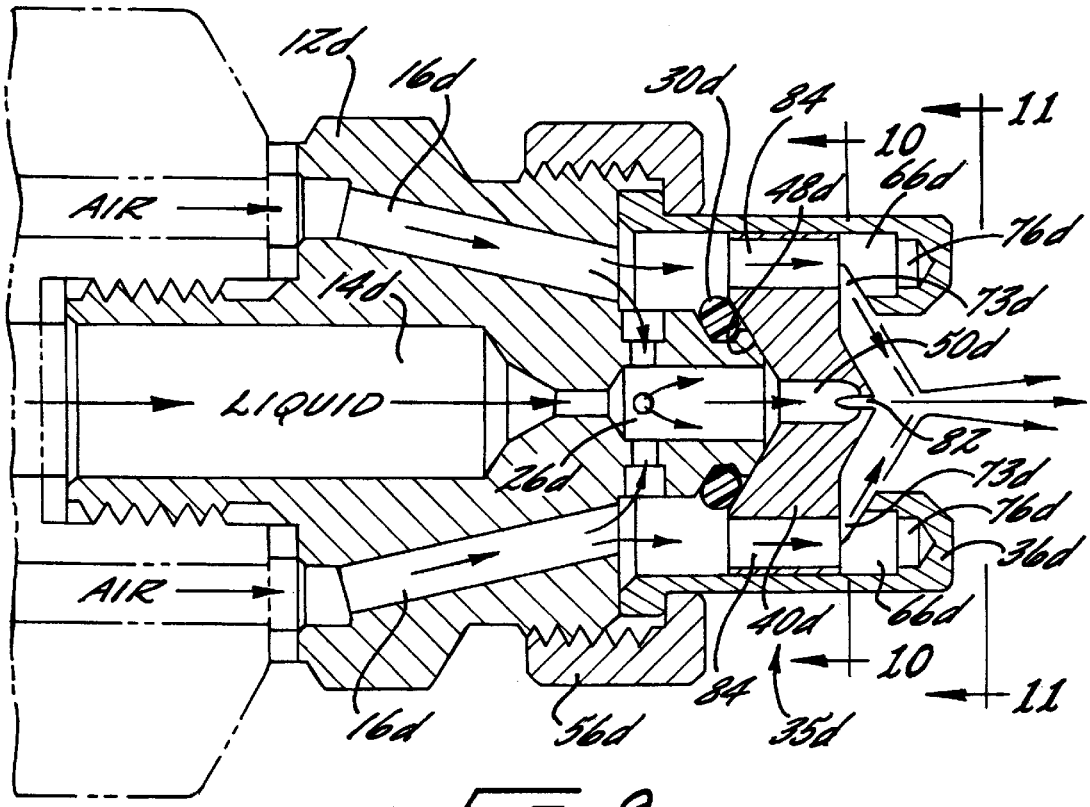
FIG. 9 is a section view taken axially through another alternative embodiment of a spray nozzle assembly according to the present invention.
Figure 10:
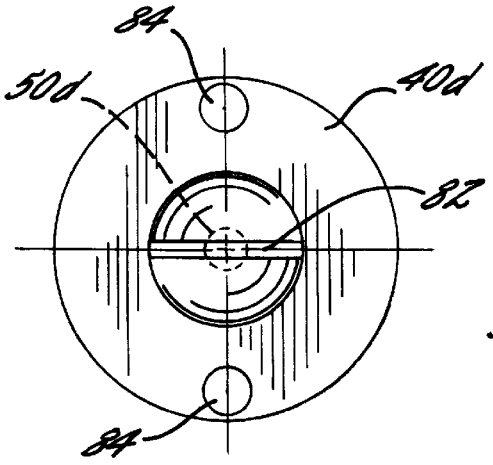
FIG. 10 is a cross-sectional view taken through the plane of line 10—10 of FIG. 9.
Figure 11:
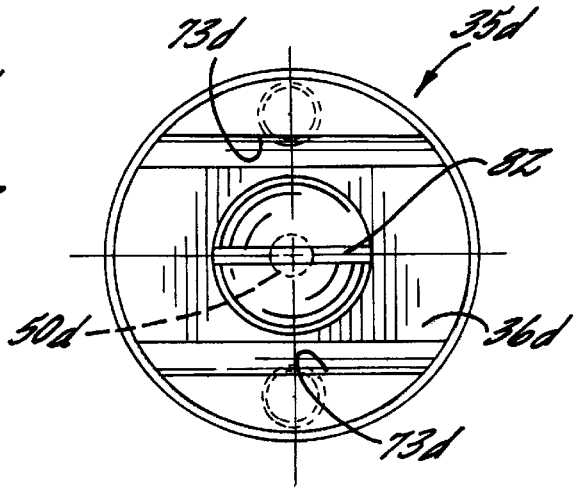
FIG. 11 is an end view taken through the plane of line 11—11 of FIG. 9.

In accordance with a further aspect of the present invention, to further reduce the air pressure needed to atomize the fluid particles, thus further enhancing the efficiency of the nozzle, the air cap can include a fluid directing insert 40*d* which includes a central elongated slot type discharge orifice 82. The additional atomization effected by virtue of the slot or elongated discharge orifice 82 enables the air pressure to be reduced, lowering the force of the discharging spray pattern, as well as reducing energy costs associated with the operation of the nozzle. As shown in FIGS. 9–11, in which the distinguishing suffix "d" is used to describe items similar to those already described, this embodiment of the air cap 35*d* can be used with nozzle bodies incorporating pre-atomizing sections. More specifically, the fluid directing insert 40*d* is press fit into the outer body 36*d* such that when the air cap 35*d* is assembled to the nozzle body 12*d*, the upstream side of the fluid directing insert engages the open discharge end of the pre-atomizing section 26*d*. A central fluid orifice 50*d* is provided in the fluid directing insert 40*d* which directs the fluid exiting the pre-atomizing section through the central discharge slot 82 which is provided in the downstream side of the fluid directing insert 40*d*. The discharge slot 82 forces the pre-atomized liquid into an elongated fan shaped pattern, which causes further breakdown of the fluid particles.

For directing air through the air cap 35*d*, the fluid directing insert 40*d* also includes a plurality of air directing orifices 84, in this case two, arranged in circumferentially spaced relation adjacent the perimeter of the fluid directing insert 40*d*. When the air cap 35*d* is mounted on the nozzle body 12*d*, the open upstream ends of the air directing orifices 84 are aligned with the gas inlet passage 16*d* in the nozzle body such that a portion of the flow of pressurized air bypasses the pre-atomizing section 26*d*. The air which bypasses the pre-atomizing section 26*d* is directed via the air directing orifices 84 into the discharge passages 66*d* formed in the air cap body 36*d* each of which includes, in this case, a downstream pocket or recess 76*d*. A discharge orifice 73*d* comprising in this instance a radially inwardly angled notch is provided in each discharge passage 66*d*. As shown in FIG. 9, the air discharge orifices 73*d* are arranged in opposed relation so that the discharging air streams impinge on the liquid discharge stream emanating from the discharge slot 82. Thus, the liquid discharge from the discharge slot 82 is further atomized by the external air streams. As will be appreciated, the air cap provides increased atomization of the fluid which enables use of lower pressure air streams, thereby reducing the nozzle discharge pressure and enhancing the efficiency of the nozzle.

Figure 12:
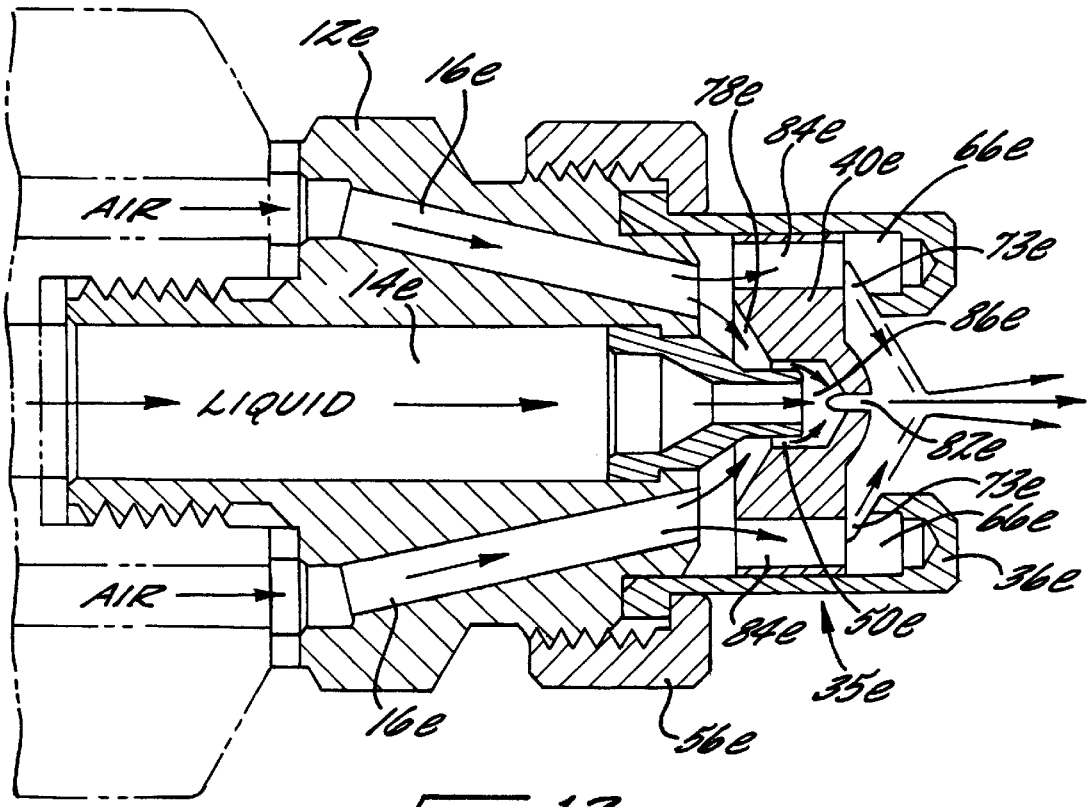
FIG. 12 is a section view taken axially through still another alternative embodiment of a spray nozzle assembly according to the present invention.

Alternatively, as shown in FIG. 12 (similar items having the suffix "e"), the air cap configuration of FIGS. 9–11 can also be used on a nozzle body which does not utilize a pre-atomizing section. More specifically, when the air cap 35*e* is mounted on the nozzle body 12*e*, the end portion of the fluid inlet passage 14*e* extends into the central fluid passageway 50*e* of the fluid directing insert 40*e*. Since the central fluid passageway 40*e* is larger than the fluid inlet 14*e*, an annular space 78*e* is defined surrounding the fluid inlet 14*e* through which air can flow. Accordingly, the air passing into the air cap 35*e* from the gas inlet passage 16*e* of the nozzle body 12*e* is divided such that a portion is directed into the plurality of air directing orifices 84 and a portion is directed into the central fluid directing orifice 50*e* via the annular space 78*e*. The air directed into the central fluid directing orifice 50*e* mixes with the fluid in a pocket 86 in the central orifice 50*e* downstream from the discharge end of the fluid inlet 14*e* before it exits through the discharge slot 82*e*. The fluid is then further atomized as it is discharged through the discharge slot 82*e* and impinged upon by the external air streams from the air discharge orifices 73*e*.

From the foregoing it can be seen that the present invention provides an air cap which is both very versatile and easy to manufacture. In particular, the same basic air cap configuration can be used on air assisted nozzle bodies of various designs and can be easily customized for a desired discharging spray pattern. Additionally, the air cap allows the nozzle to operate in an efficient and economic manner.

What is claimed is:

1. An air assisted spray nozzle assembly comprising:

a nozzle body having a liquid inlet passage and a gas inlet passage, and an air cap disposed at a downstream end of the nozzle body, the air cap including an outer body member having an inner bore extending from an open upstream end thereof, a fluid directing insert arranged in the inner bore of the outer body and having a passage extending therethrough which communicates with the liquid inlet passage, an impingement element arranged in the inner bore of the outer body downstream from the fluid directing insert and defining an impingement surface spaced from and opposing the passage in the fluid directing insert for deflecting a stream of liquid impinging thereon in a radially outward direction, the outer body including a plurality of longitudinally extending discharge passages arranged in surrounding relation to and extending downstream in relation to the impingement surface, each discharge passage having a discharge orifice therein for directing fluid in an inward flow path such that the flow paths produced by the respective discharge orifices impinge on one another and atomize the liquid.

2. The spray nozzle assembly according to claim 1 wherein the nozzle body includes a pre-atomizing section within which pressurized streams of liquid and air introduced through the liquid and gas inlet passages are forcefully intermixed to provide pre-atomized fluid at an open discharging end thereof.

3. The spray nozzle assembly according to claim 2 wherein the discharge end of the pre-atomizing section sealingly engages a downstream entry surface of the fluid directing insert such that pre-atomized fluid from the pre-atomizing section is directed through the fluid passage in the fluid directing insert.

4. The spray nozzle assembly according to claim 3 wherein the entry surface of the fluid directing insert is tapered towards the fluid passage.

5. The spray nozzle assembly according to claim 1 wherein the liquid inlet passage extends into the fluid passage of the fluid directing insert.

6. The spray nozzle assembly according to claim 5 wherein the liquid inlet passage and the fluid passage in the fluid directing member define an annular fluid pathway surrounding the liquid inlet passage which communicates with the gas inlet passage and directs an annular stream of pressurized air through the fluid passage in the fluid directing member for atomizing liquid deflected radially outward by the impingement surface.

7. The spray nozzle assembly according to claim 1 wherein the fluid directing insert is configured so as to be press fit into the inner bore of the outer body.

8. The spray nozzle assembly according to claim 1 wherein the impingement member is configured so as to be press fit into the inner bore of the outer body.

9. The spray nozzle assembly according to claim 8 wherein the impingement member is engaged against an annular shoulder disposed in the inner bore of the outer body.

10. The spray nozzle assembly according to claim 1 wherein the impingement member has a plurality of fluid directing orifices extending downstream from the impingement surface, each fluid directing orifice being in fluid communication with the passage in the fluid directing member and with a respective discharge passage.

11. The spray nozzle assembly according to claim 1 wherein each discharge passage includes a cavity arranged at a distal end thereof downstream from the respective discharge orifice.

12. An air assisted spray nozzle assembly comprising:

a nozzle body having a liquid inlet passage, a gas inlet passage and a pre-atomizing section within which pressurized streams of liquid and air introduced through said liquid and gas inlet passages are forcefully intermixed to pre-atomize the liquid, and an air cap disposed at a downstream end of the nozzle body, the air cap including an outer body member having an inner bore extending from an open upstream end thereof, a fluid directing member arranged in the inner bore of the outer body member and having a passage extending therethrough which communicates with the pre-atomizing section, an impingement surface arranged in the inner bore of the body member spaced from and opposing the passage in the fluid directing member for deflecting a stream of liquid impinging thereon in a radially outward direction, the outer body including a plurality of longitudinally extending discharge passages arranged in surrounding relation to and extending downstream from the impingement surface each discharge passage having a discharge orifice therein.

13. The spray nozzle assembly according to claim 12 wherein the discharge end of the pre-atomizing section sealingly engages a downstream entry surface of the fluid directing member such that pre-atomized fluid from the pre-atomizing section is directed through the fluid passage in the fluid directing member.

14. The spray nozzle assembly according to claim 13 wherein the entry surface of the fluid directing member is tapered towards the fluid passage.

15. The spray nozzle assembly according to claim 13 wherein the fluid directing member is configured so as to be press fit into the inner bore of the outer body.

16. An air assisted spray nozzle assembly comprising:

a nozzle body having a liquid inlet passage and a gas inlet passage, and an air cap removably mounted at a downstream end of the nozzle body, the air cap including an outer body member having an inner bore extending from an open upstream end thereof, a fluid directing insert fixedly mounted in the inner bore of the outer body member for removal from said nozzle body as an incident to removal of said cap, said fluid directing insert having a fluid passage therein which communicates with the liquid inlet passage when said cap is mounted on said nozzle body, the fluid passage in the fluid directing insert terminating in an elongated liquid discharge orifice for forcing the fluid into an elongated fan shaped flow path and atomizing the liquid, the fluid directing insert and the outer body defining a plurality of longitudinally extending discharge passages in communication with the gas inlet passage, each discharge passage having a discharge orifice therein for directing gas in an inward flow path such that the flow paths produced by the respective discharge orifices impinge on the fan shaped liquid flow path produced by the elongated discharge opening in the fluid directing insert to further atomize the liquid.

17. An air assisted spray nozzle assembly comprising:

a nozzle body having a liquid inlet passage and a gas inlet passage, said nozzle body including a pre-atomizing section within which pressurized streams of liquid and air introduced through the liquid and gas inlet passages are forcefully intermixed to provide pre-atomized fluid at an open discharging end thereof, and an air cap disposed at a downstream end of the nozzle body, the air cap including an outer body member having an inner bore extending from an open upstream end thereof, a fluid directing insert arranged in the inner bore of the outer body member and having a fluid passage therein which communicates with the open end of said pre-atomizing section, the fluid passage in the fluid directing insert terminating in an elongated liquid discharge orifice for forcing the fluid into an elongated fan shaped flow path and further atomizing the liquid, the fluid directing insert and the outer body defining a plurality of longitudinally extending discharge passages in communication with the gas inlet passage, each discharge passage having a discharge orifice therein for directing gas in an inward flow path such that the flow paths produced by the respective discharge orifices impinge on the fan shaped liquid flow path produced by the elongated discharge opening in the fluid directing insert to still further atomize the liquid.

18. The spray nozzle assembly according to claim 17 wherein the discharge end of the pre-atomizing section sealingly engages a downstream entry surface of the fluid directing member such that pre-atomized fluid from the pre-atomizing section is directed through the fluid passage in the fluid directing member.

19. The spray nozzle assembly according to claim 18 wherein the entry surface of the fluid directing member is tapered towards the fluid passage.

20. An air assisted spray nozzle assembly comprising:

a nozzle body having a liquid inlet passage and a gas inlet passage, and an air cap disposed at a downstream end of the nozzle body, the air cap including an outer body member having an inner bore extending from an open upstream end thereof, a fluid directing insert arranged in the inner bore of the outer body member and having a fluid passage therein into which said liquid inlet passage extends and communicates, the fluid passage in the fluid directing insert terminating in an elongated liquid discharge orifice for forcing the fluid into an elongated fan shaped flow path and atomizing the liquid, the fluid directing insert and the outer body defining a plurality of longitudinally extending discharge passages in communication with the gas inlet passage, each discharge passage having a discharge orifice therein for directing gas in an inward flow path such that the flow paths produced by the respective discharge orifices impinge on the fan shaped liquid flow path produced by the elongated discharge opening in the fluid directing insert to further atomize the liquid.

21. The spray nozzle assembly according to claim 20 wherein the liquid inlet passage and the fluid passage in the fluid directing member define an annular fluid pathway surrounding the liquid inlet passage which communicates with the gas inlet passage and directs an annular stream of pressurized air through the fluid passage in the fluid directing member for atomizing liquid in a downstream portion of the fluid passage.

22. An air assisted spray nozzle assembly comprising:

a nozzle body having a liquid inlet passage and a gas inlet passage, and an air cap disposed at a downstream end of the nozzle body, the air cap including an outer body member having an inner bore extending from an open upstream end thereof, a fluid directing insert configured so as to be press fit into the inner bore of the outer body member and having a fluid passage therein which communicates with the liquid inlet passage, the fluid passage in the fluid directing insert terminating in an elongated liquid discharge orifice for forcing the fluid into an elongated fan shaped flow path and atomizing the liquid, the fluid directing insert and the outer body defining a plurality of longitudinally extending discharge passages in communication with the gas inlet passage, each discharge passage having a discharge orifice therein for directing gas in an inward flow path such that the flow paths produced by the respective discharge orifices impinge on the fan shaped liquid flow path produced by the elongated discharge opening in the fluid directing insert to further atomize the liquid.

23. An air assisted spray nozzle assembly comprising:

a nozzle body having a liquid inlet passage and a gas inlet passage, and an air cap disposed at a downstream end of the nozzle body, the air cap including an outer body member having an inner bore extending from an open upstream end thereof, a fluid directing insert arranged in the inner bore of the outer body member and having a fluid passage therein which communicates with the liquid inlet passage, the fluid passage in the fluid directing insert terminating in an elongated liquid discharge orifice for forcing the fluid into an elongated fan shaped flow path and atomizing the liquid, said outer body defining a plurality of longitudinally extending discharge passages, said fluid directing insert having a plurality of fluid directing orifices extending therethrough, each fluid directing orifice being in fluid communication with the gas inlet passage and with a respective discharge passage, each discharge passage having a discharge orifice therein for directing gas in an inward flow path such that the flow paths produced by the respective discharge orifices impinge on the fan shaped liquid flow path produced by the elongated discharge opening in the fluid directing insert to further atomize the liquid.

24. An air assisted spray nozzle assembly comprising:

a nozzle body having a liquid inlet passage and a gas inlet passage, and an air cap disposed at a downstream end of the nozzle body, the air cap including an outer body member having an inner bore extending from an open upstream end thereof, a fluid directing insert arranged in the inner bore of the outer body member and having a fluid passage therein which communicates with the liquid inlet passage, the fluid passage in the fluid directing insert terminating in an elongated liquid discharge orifice for forcing the fluid into an elongated fan shaped flow path and atomizing the liquid, the fluid directing insert and the outer body defining a plurality of longitudinally extending discharge passages in communication with the gas inlet passage, each discharge passage having a discharge orifice therein for directing gas in an inward flow path such that the flow paths produced by the respective discharge orifices impinge on the fan shaped liquid flow path produced by the elongated discharge opening in the fluid directing insert to further atomize the liquid, and each said discharge passage including a cavity arranged at a distal end thereof downstream from the respective discharge orifice.

* * * * *